US006368231B1

(12) United States Patent
Chen

(10) Patent No.: US 6,368,231 B1
(45) Date of Patent: Apr. 9, 2002

(54) STEALTH GROOVES OF BALL-STRIKING FACE OF GOLF CLUB HEAD

(76) Inventor: Archer C. C. Chen, No. 501, 28th Rd., Taichung Industrial Park, Taichung (TW)

( * ) Notice: Subject to any disclaimer, the term of this patent is extended or adjusted under 35 U.S.C. 154(b) by 0 days.

(21) Appl. No.: 09/501,293

(22) Filed: Feb. 9, 2000

(51) Int. Cl.[7] ..... A63B 53/04
(52) U.S. Cl. ..... 473/329; 473/330; 473/350
(58) Field of Search ..... 473/131, 324, 473/342, 345, 346, 330, 331, 329, 332, 350

(56) References Cited

U.S. PATENT DOCUMENTS 2,034,936 A * 3/1936 Barnhart
4,635,941 A * 1/1987 Yoneyama
5,405,137 A * 4/1995 Vincent
5,499,814 A * 3/1996 Lu
5,643,103 A * 7/1997 Aizawa
5,766,094 A * 6/1998 Mahaffey
5,944,619 A * 8/1999 Cameron
6,093,116 A * 7/2000 Hettinger
6,193,615 B1 * 2/2001 Hirota
6,200,228 B1 * 3/2001 Takeda

* cited by examiner

*Primary Examiner*—Sebastiano Passaniti
(74) *Attorney, Agent, or Firm*—Browdy and Neimark

(57) ABSTRACT

A golf club head comprises a ball-striking plate which is disposed in the location of a ball-striking face of the golf club head. The ball-striking plate is provided in the back thereof with a plurality of supporting portions which are separated from one another by a predetermined interval. The supporting portions urge the ball-striking plate such that a plurality of stealth grooves are formed by portions, which are not urged by the supporting portions, at such time when the ball-striking plate is impacted on by a golf ball.

13 Claims, 4 Drawing Sheets

STEALTH GROOVES OF BALL-STRIKING FACE OF GOLF CLUB HEAD

FIELD OF THE INVENTION

The present invention relates generally to a golf club head, and more particularly to the hidden grooves of the golf club head.

BACKGROUND OF THE INVENTION

The ball-striking face of the golf club head is generally provided with a plurality of grooves which are intended to bring about the back spin of a golf ball so as to reduce the rolling distance of the golf ball on the ground. Such grooves as described above are defective in design in that the comer edges of the grooves can cause damage to the golf ball.

SUMMARY OF THE INVENTION

The primary objective of the present invention is to provide a golf club head with grooves which are so concealed as to prevent them from causing damage to the golf balls.

It is another objective of the present invention to provide a golf club head with grooves which are hidden to enhance the ball controllability of the golf club head.

In keeping with the principle of the present invention, the foregoing objectives of the present invention are attained by a golf club head comprising a ball-striking face plate which is provided in the back thereof with a predetermined number of supporting portions separated from one another at an interval. The plate is supported by the supporting portions such that the portions which are not supported by the supporting portions are deformed at such time when the ball-striking face plate is impacted on by a golf ball.

DETAILED DESCRIPTION OF THE INVENTION

Figure 1:
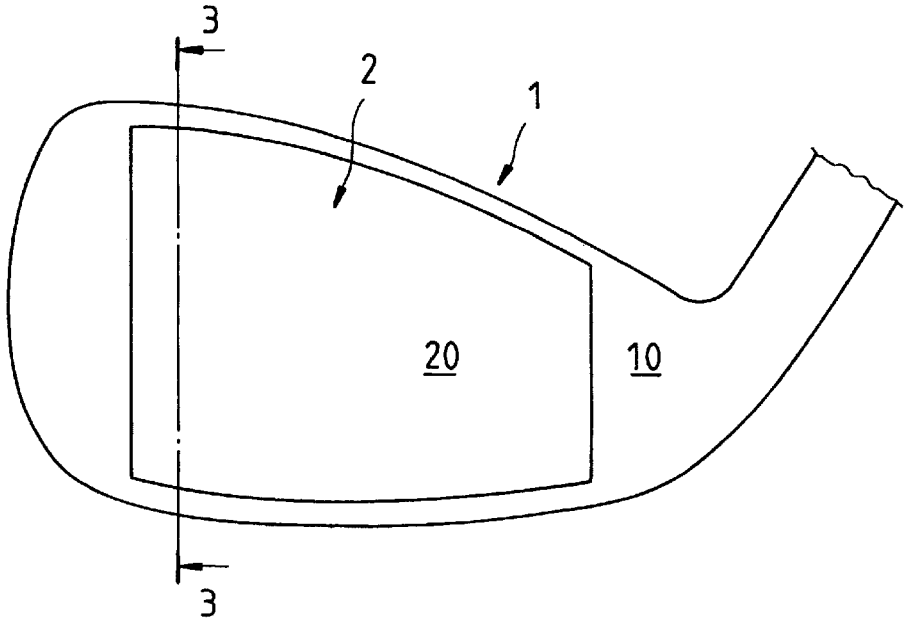
FIG. 1 shows a front view of an iron golf club head of a first preferred embodiment of the present invention.

As shown in FIG. 1, an iron golf club head 1 comprises a ball-striking face 2 which is made of a metal thin plate 20 devoid of grooves. The metal thin plate 20 of the present invention is made of stainless steel, maraging steels, titanium alloy, etc. The metal thin plate 20 has a thickness ranging between 0.2 mm and 1.5 mm. The metal thin plate 20 of the first preferred embodiment of the present invention is made of a stainless steel plate having a thickness of 0.63 mm.

Figure 2:
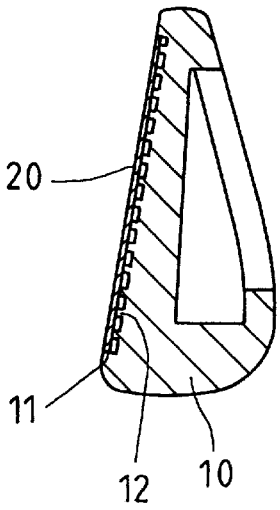
FIG. 2 shows a sectional view taken along the direction indicated by a line 3—3 as shown in FIG. 1.

As shown in FIG. 2, the iron golf club head 1 has a main body 10 which is made integrally of stainless steel by lost wax casting, or forging. The main body 10 is provided with a recess 11 corresponding in location to the ball-striking face 2. The recess 11 is provided in the bottom wall thereof with a plurality of supporting portions 12 which are raised and parallel to one another. The supporting portions 12 of the present invention are separated from one another by a distance of 2.5 mm. The metal thin plate 20 is inlaid in the recess 11 to form a ball-striking plate 20 such that the back of the metal thin plate 20 is fastened with the supporting portions 12 by lap joint. The ball-striking plate 20 is fixed on the main body 10 by sintering, hard soldering, scarfing, or combination of the above.

As the ball-striking plate 20 is impacted on by a golf ball, the portions which are supported on by the supporting portions 12 are immune from deformation. In the meantime, the portions which are not supported on by the supporting portions 12 are forced by the impact force to deform, thereby resulting in the formation of grooves. As soon as the ball-striking plate 20 is relieved of the impact force, the ball-striking plate 20 recovers its original form.

The test results of the No. 5 iron golf club head without grooves are presented in the attached Table 1, whereas the test results of the conventional No. 5 iron golf club head with grooves are presented in the attached Table 2 for comparison. As far as the golf club head of the present invention is concerned, the revolutions of the spin of the ball are about 6900 as compared with 5800 of the conventional golf club head. In terms of the center hit, the carry distance of the present invention is about 167 yards, with the total distance being 172 yards, and with the rolling distance being about 5 yards. The carry distance of the conventional golf club head is about 175 yards, with the total distance being 184 yards, and with the rolling distance being 9 yards. The carry dispersion of the present invention is within the range of 1.38 feet, as compared with 4.13 feet of the conventional golf club head. The stationary dispersion of the present invention is within the range of 2.16 feet, as compared with 3.84 feet of the conventional golf club head. It is therefore readily apparent that the ball-striking face of the iron golf club head of the present invention is superior in ball controllability to the ball-striking face of the iron golf club head of the prior art. The stealth grooves of the present invention account for the superiority of the golf club head of the present invention.

Figure 3:
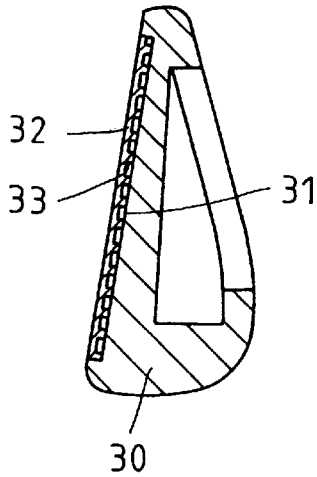
FIG. 3 shows a sectional view of a second preferred embodiment of the present invention, with the sectional view being taken along the direction similar to the line 3—3 as shown in FIG. 1.

As shown in FIG. 3, the second preferred embodiment of the present invention has a main body 30 which is provided with a recess 31 corresponding in location to the ball-striking face, and a ball-striking plate 32 which is provided in the back thereof with a plurality of supporting portions 33. These supporting portions 33 are raised and parallel to one another such that the supporting portions 33 urge the bottom wall of the recess 31.

Figure 4:
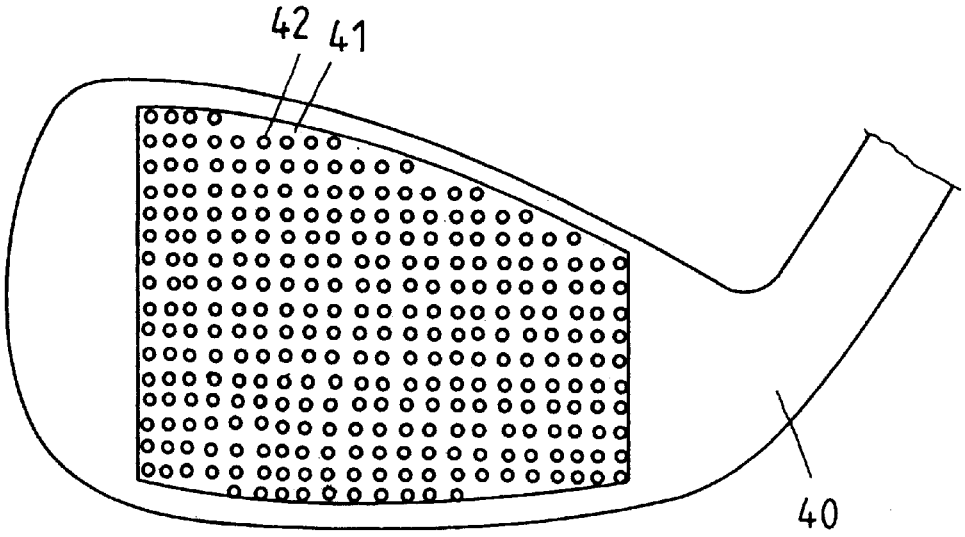
FIG. 4 shows a front view of the main body of a golf club head of a third preferred embodiment of the present invention.

As shown in FIG. 4, the third preferred embodiment of the present invention has a main body 40 which is provided with a recess 41 which is in turn provided in the bottom wall thereof with a predetermined number of pillar-shaped supporting portions 42 arranged separately. A ball-striking plate (not shown in the drawing) is inlaid in the recess 41.

Figure 5:
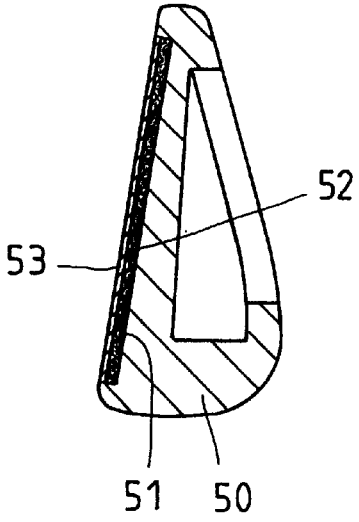
FIG. 5 shows a sectional view of a fourth preferred embodiment of the present invention, with the sectional view being taken along the direction similar to the line 3—3 as shown in FIG. 1.

As shown in FIG. 5, the fourth preferred embodiment of the present invention has a main body 50 which is provided with a recess 51 and a corrugated support plate 52 disposed in the recess 51 to form a supporting portion. A ball-striking thin plate 53 is inlaid in the recess 51, thereby resulting in the formation of a plurality of stealth grooves. It must be noted here that the corrugated support plate 52 and the ball-striking plate 53 are first joined together before they are disposed in the recess 51.

Figure 6:
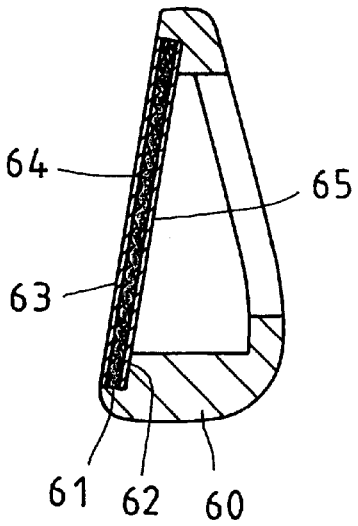
FIG. 6 shows a sectional view of a fifth preferred embodiment of the present invention, with the sectional view being taken along the direction similar to the line 3—3 as shown in FIG. 1.

As shown in FIG. 6, the fifth preferred embodiment of the present invention has a main body 60 which is provided with a recess 61 corresponding in location to the ball-striking face. The recess 61 is provided in the underside thereof with an empty center, and in the periphery thereof with a shoulder 62. A ball-striking plate 63 is provided in the back thereof with a corrugated support plate 64 which is in turn provided in the back thereof with a back plate 65. Such a sandwiched structure as described above is fixed with the shoulder 62. The support plate 64 is used to provide the ball-striking plate 63 with a support for an interval. The back plate 65 is intended to provide the support plate 64 with a back support.

Figure 7:
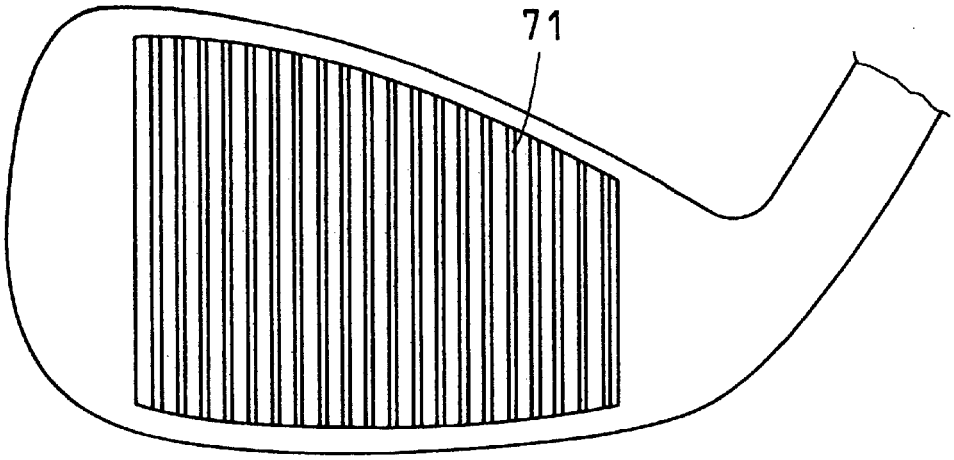
FIG. 7 shows a front view of the main body of a golf club head of a sixth preferred embodiment of the present invention.
Figure 8:
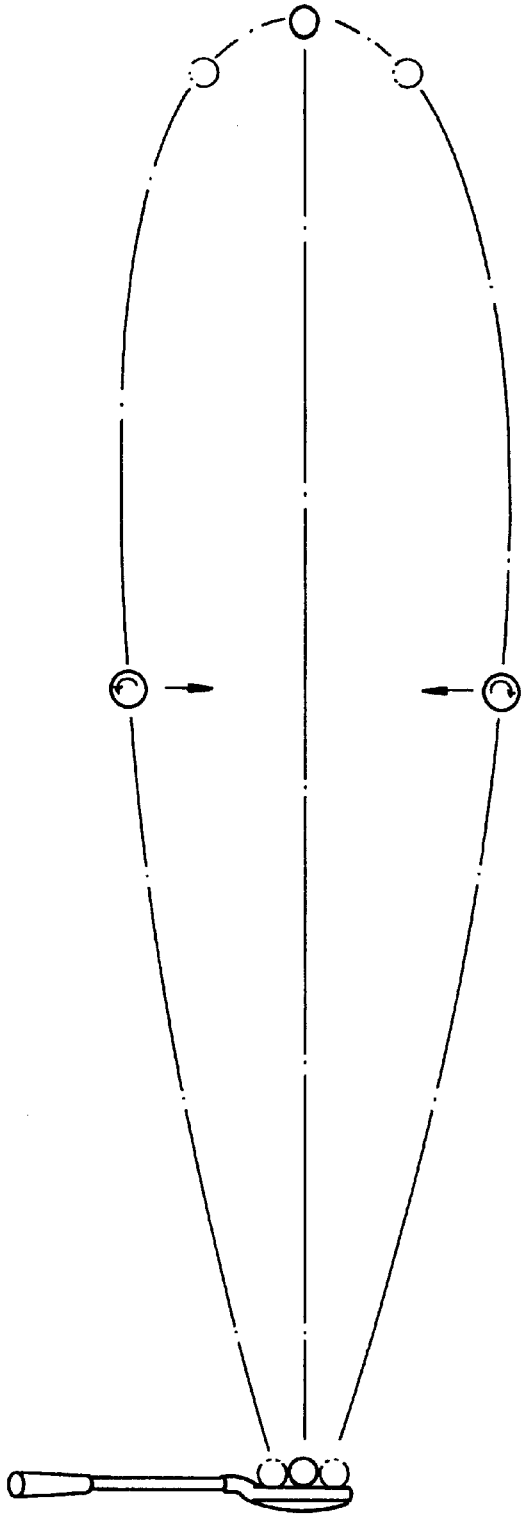
FIG. 8 shows a schematic view of the so-called gear effect of an airborne golf ball.

As shown in FIG. 7, these supporting portions 71 are arranged in a plummet manner and are parallel to one another. Whenever the ball-striking action is deviated, the stealth grooves of the present invention enable the ball to spin. In light of the principle of air mechanics, the airborne ball flies in a curved path such that the ball corrects automatically its flight direction. This phenomenon is known as gear effect, as illustrated in FIG. 8.

Figure 9:
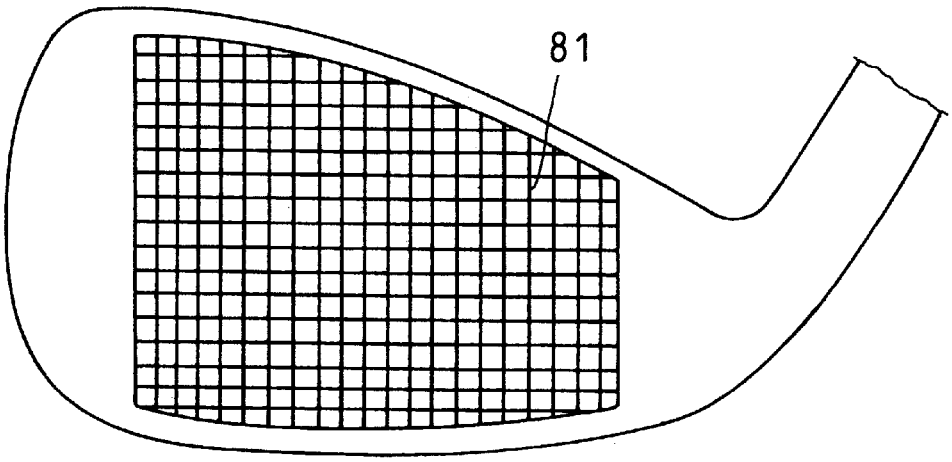
FIG. 9 shows a front view of the main body of a golf club head of a seventh preferred embodiment of the present invention.

As shown in FIG. 9, the supporting portion 81 is of a netlike construction and is therefore capable of enhancing the back spin and the gear effect of the golf club head.

The supporting portion of the present invention is disposed on the main body of the golf club head of the present invention, regardless of the form that the supporting portion takes. The supporting portion may be also disposed on the back of the ball-striking plate or a support plate. In addition, the ball-striking face of the ball-striking plate of the present invention may be either flat or rugged.

What is claimed is:

1. A golf club head comprising:

a main body;

a ball-striking plate;

a plurality of supporting portions engaged between the main body and a back face of the ball-striking plate and separated from one another by a vacant interval;

wherein a width of the ball-striking plate is uniform throughout and is such that a stealth groove is formed by deformation on a front face of the ball-striking plate above each vacant interval when said ball-striking plate is impacted by a golf ball, and wherein the ball-striking plate recovers to an original form after impact.

2. The golf club head as defined in claim 1, wherein said supporting portions are of a pillar-shaped construction and are separated from one another by a predetermined interval.

3. The golf club head as defined in claim 1, wherein said supporting portions are of a bar-shaped construction and are parallel to one another.

4. The golf club head as defined in claim 1, wherein said supporting portions are arranged in a plummet manner and are parallel to one another.

5. The golf club head as defined in claim 1, wherein said supporting portions are arranged in a network manner.

6. The golf club head as defined in claim 1, wherein said ball-striking plate has a thickness ranging between 0.2 mm and 1.5 mm.

7. The golf club head as defined in claim 7 further comprising a recess in the main body which is provided at a bottom thereof with a plurality of supporting portions; and wherein said ball-striking plate is inlaid in said recess such that a back of said ball-striking plate is connected with said supporting portions.

8. The golf club head as defined in claim 7, wherein said supporting portions are integrally made with said bottom of said recess.

9. The golf club head as defined in claim 7, wherein said supporting portions are formed of a supporting plate disposed between said ball-striking plate and said bottom of said recess.

10. The golf club head as defined in claim 9, wherein said support plate is fastened with the back face of said ball-striking plate.

11. The golf club head as defined in claim 9, wherein said support plate is provided in a back thereof with a back plate for forming a back supporting structure of said support plate.

12. The golf club head as defined in claim 1, wherein said supporting portions are integrally made with the back face of said ball-striking plate; wherein said ball-striking plate is corresponding in location to a ball-striking face of said main body whereby said main body is provided with a recess corresponding in location to said ball-striking face and having a bottom thereof a support surface which is urged by said supporting portions of said ball-striking plate.

13. A golf club head comprising:

a main body;

a ball-striking plate;

a plurality of supporting portions engaged between the main body and a back face of the ball-striking plate and separated from one another by a vacant interval;

said supporting portions being included in a supporting plate disposed between the ball-striking plate and a bottom of a recess in the main body;

wherein a width of the ball-striking plate is uniform and ranges between 0.2 mm and 1.5 mm throughout so that a stealth groove is formed by deformation on a front face of the ball-striking plate above each vacant interval when said ball-striking plate is impacted by a golf ball, and wherein the ball-striking plate recovers to an original form after impact.

* * * * *